US011466350B2

(12) United States Patent
Hasegawa et al.

(10) Patent No.: US 11,466,350 B2
(45) Date of Patent: Oct. 11, 2022

(54) HIGH-STRENGTH STEEL SHEET AND PRODUCTION METHOD THEREFOR

(71) Applicant: JFE Steel Corporation, Tokyo (JP)

(72) Inventors: Hiroshi Hasegawa, Tokyo (JP); Tatsuya Nakagaito, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 119 days.

(21) Appl. No.: 16/969,996

(22) PCT Filed: Feb. 6, 2019

(86) PCT No.: PCT/JP2019/004148

§ 371 (c)(1),
(2) Date: Aug. 14, 2020

(87) PCT Pub. No.: WO2019/159771

PCT Pub. Date: Aug. 22, 2019

(65) Prior Publication Data

US 2021/0102278 A1 Apr. 8, 2021

(30) Foreign Application Priority Data

Feb. 19, 2018 (JP) ..... JP2018-026743

(51) Int. Cl.
*C21D 9/46* (2006.01)
*C22C 38/54* (2006.01)
(Continued)

(52) U.S. Cl.
CPC ..... *C22C 38/54* (2013.01); *C21D 8/0226* (2013.01); *C21D 8/0236* (2013.01); *C21D 9/46* (2013.01);
(Continued)

(58) Field of Classification Search
CPC .. B32B 15/18; C21D 1/20; C21D 1/25; C21D 1/26; C21D 1/78; C21D 2211/001;
(Continued)

(56) References Cited

U.S. PATENT DOCUMENTS

2015/0034219 A1 2/2015 Kawabe et al.
2015/0274213 A1 10/2015 Takagi et al.
2017/0145534 A1* 5/2017 Takashima ..... C22C 38/14
2017/0204491 A1 7/2017 Kawasaki et al.
(Continued)

FOREIGN PATENT DOCUMENTS

CN 106170574 A 11/2010
CN 107208206 A 9/2017
(Continued)

OTHER PUBLICATIONS

International Search Report and Written Opinion for International Application No. PCT/JP2019/004148, dated May 7, 2019, 4 pages.
(Continued)

*Primary Examiner* — Jie Yang
(74) *Attorney, Agent, or Firm* — RatnerPrestia

(57) ABSTRACT

There are provided a high-strength steel sheet excellent in strength, workability in terms of, for example, λ, and energy absorption characteristics, and a production method therefor.

The high-strength steel sheet has a specific component composition and a steel microstructure containing, on an area percent basis, 1% to 35% ferrite having an aspect ratio of 2.0 or more, 10% or less ferrite having an aspect ratio of less than 2.0, less than 5% non-recrystallized ferrite, 40% to 80% in total of bainite and martensite containing carbide,
(Continued)

5% to 35% in total of fresh martensite and retained austenite, and 3% to 35% retained austenite, the retained austenite having a C content of 0.40% to 0.70% by mass.

14 Claims, 1 Drawing Sheet

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C23C 2/12*** | (2006.01) |
| ***C23C 2/40*** | (2006.01) |

(52) U.S. Cl.
CPC ..... *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C23C 2/12* (2013.01); *C23C 2/40* (2013.01); *C21D 2211/001* (2013.01); *C21D 2211/002* (2013.01); *C21D 2211/005* (2013.01); *C21D 2211/008* (2013.01)

(58) Field of Classification Search
CPC ..... C21D 2211/005; C21D 2211/008; C21D 9/46; C22C 38/001; C22C 38/002; C22C 38/008; C22C 38/02; C22C 38/04; C22C 38/06; C22C 38/08; C22C 38/12; C22C 38/14; C22C 38/16; C22C 38/18; C22C 38/40; C22C 38/54; C25D 5/36; C23D 5/36
USPC ..... 148/518
See application file for complete search history.

(56) References Cited

U.S. PATENT DOCUMENTS

| | | | | |
|---|---|---|---|---|
| 2017/0314091 | A1 | 11/2017 | Kawasaki et al. | |
| 2017/0327924 | A1 | 11/2017 | Hoydick et al. | |
| 2018/0002800 | A1* | 1/2018 | Hasegawa | C21D 8/0205 |
| 2019/0211427 | A1 | 7/2019 | Sano et al. | |
| 2020/0165708 | A1 | 5/2020 | Hasegawa et al. | |
| 2021/0130920 | A1* | 5/2021 | Yoshitomi | C23C 2/28 |

FOREIGN PATENT DOCUMENTS

| | | | | |
|---|---|---|---|---|
| CN | 107406930 | A | 11/2017 | |
| CN | 107709593 | A | 2/2018 | |
| EP | 2617849 | A1 | 7/2013 | |
| EP | 2881481 | A1 | 6/2015 | |
| EP | 3128027 | A1 | 2/2017 | |
| EP | 3219822 | A1 | 9/2017 | |
| EP | 3476963 | A1 | 5/2019 | |
| JP | 2013185196 | A | 9/2013 | |
| JP | 2016006209 | A | 1/2016 | |
| JP | 6123966 | B1 | 5/2017 | |
| JP | 2017145469 | A | 8/2017 | |
| WO | 2014077294 | A1 | 5/2014 | |
| WO | 2016067625 | A1 | 5/2016 | |
| WO | WO-2016113789 | A1 * | 7/2016 | B32B 15/013 |
| WO | 2017138384 | A1 | 8/2017 | |
| WO | 2017208762 | A1 | 12/2017 | |
| WO | 2018043456 | A1 | 3/2018 | |

OTHER PUBLICATIONS

Korean Grant of Patent for Korean Application No. 10-2020-7023508, dated Dec. 22, 2021 with translation, 4 pages.
Chinese Office Action for Chinese Application No. 201980014014.X, dated Nov. 12, 2021, with Concise Statement of Relevance of Office Action, 6 pages.
Extended European Search Report for European Application No. 19753899.4, dated Oct. 14, 2020, 9 pages.
Chinese Office Action for Chinese Application No. 201980014014.X, dated Apr. 30, 2021 with Concise Statement of Relevance of Office Action, 10 pages.

* cited by examiner

HIGH-STRENGTH STEEL SHEET AND PRODUCTION METHOD THEREFOR

CROSS REFERENCE TO RELATED APPLICATIONS

This is the U.S. National Phase application of PCT/JP2019/004148, filed Feb. 6, 2019, which claims priority to Japanese Patent Application No. 2018-026743, filed Feb. 19, 2018, the disclosures of these applications being incorporated herein by reference in their entireties for all purposes.

FIELD OF THE INVENTION

The present invention relates to a high-strength steel sheet suitable for automotive members and a production method therefor.

BACKGROUND OF THE INVENTION

Steel sheets used for automotive components have been required to have higher strength from the viewpoints of improving crashworthiness and fuel economy of automobiles. However, increasing the strength of a steel sheet typically leads to a decrease in workability. For this reason, there has been a demand for the development of a steel sheet excellent in both strength and workability.

In particular, high-strength steel sheets having a tensile strength (hereinafter, also referred to as "TS") of more than 1,180 MPa have high degrees of forming difficulty (low workability) and are easily broken when subjected to large deformation. For this reason, it is difficult to use high-strength steel sheets for members that absorb energy during large deformation, such as impact-absorbing members. Here, the large deformation refers to bellows-like buckling deformation with a bending angle of 90° or more. Automotive components are required to have high resistance to rust because they are in corrosive environments. As a steel sheet having high strength and high workability, Patent Literature 1 discloses a technique regarding a steel sheet excellent in workability. As a steel sheet suitable for an energy-absorbing member, Patent Literature 2 discloses a steel sheet excellent in axial crushing characteristics.

PATENT LITERATURE

PTL 1: Japanese Patent No. 6123966

PTL 2: Domestic Re-publication of PCT International Publication for Patent Application No. 2014-77294

SUMMARY OF THE INVENTION

In the technique disclosed in Patent Literature 1, a high strength and excellent workability are achieved by controlling retained austenite; however, an example in which high levels of tensile strength (TS), uniform elongation, and a hole expansion ratio (hereinafter, λ) are all achieved at the same time is not described. No consideration is given to axial crushing characteristics and so forth sufficient for use in energy-absorbing members.

In the technique disclosed in Patent Literature 2, excellent axial crushing characteristics are obtained; however, the tensile strength (TS) is only 980 MPa class. Additionally, no consideration is given to workability in terms of, for example, λ, for processing into members.

Aspects of the present invention have been accomplished to solve the foregoing problems and aims to provide a high-strength steel sheet excellent in strength, workability in terms of, for example, λ, and energy absorption characteristics and a production method therefor.

The inventors have conducted intensive studies to solve the foregoing problems and have found that a steel sheet having a component composition adjusted to a specific range and having a steel microstructure containing 1% to 35% ferrite having an aspect ratio of 2.0 or more, 10% or less ferrite having an aspect ratio of less than 2.0, less than 5% non-recrystallized ferrite, 40% to 80% in total of bainite and martensite containing carbide, and 5% to 35% in total of fresh martensite and retained austenite, 3% to 35% retained austenite, the retained austenite having a C content of 0.40% to 0.70% by mass, is excellent in workability and energy absorption characteristics even if the steel sheet has 1,180 MPa tensile strength.

In accordance with aspects of the present invention, the term "high strength" indicates that the tensile strength (TS) is 1,180 MPa or more. The term "excellent in workability" indicates that uniform elongation is 9.0% or more and λ is 30% or more. The term "excellent in energy absorption characteristics" indicates that no large crack is formed in a steel sheet during axial crushing. The term "large crack" refers to a crack having a length of 50 mm or more.

Aspects of the present invention have been made on the basis of these findings. An outline of aspects of the present invention is described below.

[1] A high-strength steel sheet has a component composition containing, on a percent by mass basis, C: 0.12% to 0.30%, Si: 0.5% to 3.0%, Mn: 2.0% to 4.0%, P: 0.100% or less, S: 0.02% or less, Al: 0.01% to 1.50%, and at least one selected from V: 0.1% to 1.5%, Mo: 0.1% to 1.5%, Ti: 0.005% to 0.10%, and Nb: 0.005% to 0.10%, the balance being Fe and incidental impurities, and a steel microstructure containing, on an area percent basis, 1% to 35% ferrite having an aspect ratio of 2.0 or more, 10% or less ferrite having an aspect ratio of less than 2.0, less than 5% non-recrystallized ferrite, 40% to 80% in total of bainite and martensite containing carbide, 5% to 35% in total of fresh martensite and retained austenite, and 3% to 35% retained austenite, the retained austenite having a C content of 0.40% to 0.70% by mass.

[2] The high-strength steel sheet described in [1] further contains, on a percent by mass basis, at least one element selected from Cr: 0.005% to 2.0%, Ni: 0.005% to 2.0%, Cu: 0.005% to 2.0%, B: 0.0003% to 0.0050%, Ca: 0.001% to 0.005%, REM: 0.001% to 0.005%, Sn: 0.005% to 0.50%, and Sb: 0.005% to 0.50%.

[3] The high-strength steel sheet described in [1] or [2] further includes a coated layer.

[4] In the high-strength steel sheet described in [3], the coated layer is a hot-dip galvanized layer or a hot-dip galvannealed layer.

[5] A method for producing a high-strength steel sheet includes a hot-rolling step of hot-rolling a slab having a component composition described in [1] or [2], performing cooling, and performing coiling at 590° C. or lower, a cold-rolling step of cold-rolling a hot-rolled sheet obtained in the hot-rolling step at a rolling reduction of 20% or more, a pre-annealing step of heating a cold-rolled sheet obtained in the cold-rolling step to 830° C. to 940° C., holding the steel sheet in the temperature range of 830° C. to 940° C. for 10 seconds or more, and cooling the steel sheet to 550° C. or lower at an average cooling rate of 5° C./s or more, and a main-annealing step of heating the steel sheet after the pre-annealing step to Ac1+60° C. to Ac3, holding the steel sheet in the temperature range of Ac1+60° C. to Ac3 for 10 seconds or more, cooling the steel sheet to 550° C. at an average cooling rate of 10° C./s or more, holding the steel in a temperature range of 550° C. to 400° C. for 2 to 10 seconds, cooling the steel sheet to 150° C. to 375° C. at an average cooling rate of 5° C./s or more, reheating the steel sheet to 300° C. to 450° C., and holding the steel sheet in the temperature range of 300° C. to 450° C. for 10 to 1,000 seconds.

[6] The method for producing a high-strength steel sheet described in [5] further includes a coating step of subjecting the steel sheet after the main-annealing step to coating treatment.

[7] In the method for producing a high-strength steel sheet described in [6], the coating treatment is hot-dip galvanizing treatment or coating treatment in which hot-dip galvanizing treatment is performed and then alloying treatment is performed.

According to aspects of the present invention, the high-strength steel sheet excellent in workability and energy absorption characteristics can be obtained. The high-strength steel sheet according to aspects of the present invention is suitable as a material for automotive components.

DETAILED DESCRIPTION OF EMBODIMENTS OF THE INVENTION

Figure 1:
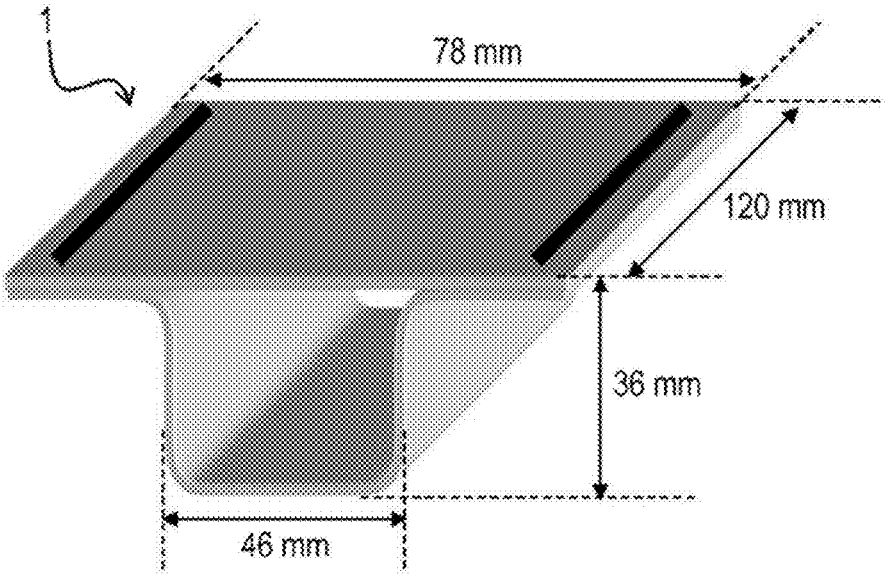
FIG. 1 is a perspective view of an axial crushing component 1.

Embodiments of the present invention will be described below. The present invention is not limited to these embodiments. The symbol "%" that denotes the component content of a component composition refers to "% by mass" unless otherwise specified.

C: 0.12% to 0.30%

C is an element effective in forming martensite and bainite to increase tensile strength (TS) and obtaining retained austenite. At a C content of less than 0.12%, these effects are not sufficiently provided, failing to obtain desired strength or a desired steel microstructure.

Accordingly, the C content needs to be 0.12% or more. The C content is preferably 0.14% or more, more preferably 0.15% or more. At a C content of more than 0.30%, the amount of C in austenite during annealing is increased to inhibit bainite transformation and martensite transformation, thus failing to obtain a desired steel microstructure. Accordingly, the C content needs to be 0.30% or less. The C content is preferably 0.25% or less, more preferably 0.23% or less.

Si: 0.5% to 3.0%

Si is an element necessary for an increase in tensile strength (TS) by solid-solution hardening of steel and for obtaining retained austenite. To sufficiently provide these effects, the Si content needs to be 0.5% or more. The Si content is preferably 0.6% or more, more preferably 0.8% or more. A Si content of more than 3.0% results in the embrittlement of steel to fail to obtain desired energy absorption characteristics or desired hole expansion formability. Accordingly, the Si content needs to be 3.0% or less. The Si content is preferably 2.5% or less, more preferably 2.0% or less.

Mn: 2.0% to 4.0%

Mn is an element effective in forming martensite and bainite to increase tensile strength (TS). At a Mn content of less than 2.0%, the effect of increasing tensile strength (TS) is not sufficiently provided. Accordingly, the Mn content needs to be 2.0% or more. The Mn content is preferably 2.1% or more, more preferably 2.2% or more. A Mn content of more than 4.0% results in the embrittlement of steel to fail to obtain desired energy absorption characteristics or desired hole expansion formability. Accordingly, the Mn content needs to be 4.0% or less. The Mn content is preferably 3.7% or less, more preferably 3.4% or less.

P: 0.100% or Less (not Including 0%)

P embrittles grain boundaries to deteriorate energy absorption characteristics; thus, the P content is preferably minimized. The P content can be acceptable up to 0.100% or less. The lower limit need not be particularly specified. A P content of less than 0.001% leads to a decrease in production efficiency. Accordingly, the P content is preferably 0.001% or more.

S: 0.02% or Less (not Including 0%)

S increases inclusions to deteriorate energy absorption characteristics; thus, the S content is preferably minimized. The S content can be acceptable up to 0.02% or less. The lower limit need not be particularly specified. A S content of less than 0.0001% leads to a decrease in production efficiency. Accordingly, the S content is preferably 0.0001% or more.

Al: 0.01% to 1.50%

Al acts as a deoxidizer and is preferably added in a deoxidization step. Al is an element effective in forming retained austenite. To provide these effects, the Al content needs to be 0.01% or more. The Al content is preferably 0.02% or more, more preferably 0.03% or more. An Al content of more than 1.50% results in the formation of an excessive amount of ferrite to fail to obtain a desired steel microstructure. Accordingly, the Al content needs to be 1.50% or less. The Al content is preferably 1.00% or less, more preferably 0.70% or less.

At Least One Selected from V: 0.1% to 1.5%, Mo: 0.1% to 1.5%, Ti: 0.005% to 0.10%, and Nb: 0.005% to 0.10%

V, Mo, Ti, and Nb are important elements in order to obtain excellent energy absorption characteristics in accordance with aspects of the present invention. The mechanism thereof is not clear but is presumably as follows: fine carbide is formed to inhibit the formation of voids around martensite grains. To provide the effect, the amount of at least one of V, Mo, Ti, and Nb contained needs to be the above-described lower limit or more. When the amounts of V, Mo, Ti, and Nb contained are more than the respective upper limits thereof, carbides coarsen to decrease the amount of carbon dissolved in steel and to form a large amount of ferrite, thereby failing to the formation of a desired steel microstructure. Regarding V, Mo, Ti, and Nb, accordingly, at least one selected from V: 0.1% to 1.5%, Mo: 0.1% to 1.5%, Ti: 0.005% to 0.10%, and Nb: 0.005% to 0.10% needs to be contained.

The V content is preferably 0.2% or more. The V content is preferably 1.0% or less, more preferably 0.6% or less.

The Mo content is preferably 0.2% or more. The Mo content is preferably 1.0% or less, preferably 0.6% or less.

The Ti content is preferably 0.010% or more, more preferably 0.020% or more. The Ti content is preferably 0.07% or less, more preferably 0.05% or less.

The Nb content is preferably 0.007% or more, more preferably 0.010% or more. The Nb content is preferably 0.07% or less, more preferably 0.05% or less.

When V, Mo, Ti, and Nb are contained in amounts of less than the respective lower limits described above, these elements are regarded as incidental impurities.

If necessary, at least one of the following elements may be appropriately contained as an optional component.

Cr: 0.005% to 2.0%, Ni: 0.005% to 2.0%, Cu: 0.005% to 2.0%, B: 0.0003% to 0.0050%, Ca: 0.001% to 0.005%, REM: 0.001% to 0.005%, Sn: 0.005% to 0.50%, and Sb: 0.005% to 0.50%

Cr, Ni, and Cu are elements effective in forming martensite and bainite to increase the strength. To provide these effects, the Cr content, the Ni content, and the Cu content are preferably equal to or higher than the respective lower limits. When the Cr content, the Ni content, and the Cu content are more than the respective upper limits, the hole expansion formability may be deteriorated, which is not preferred.

The Cr content is more preferably 0.010% or more, particularly preferably 0.020% or more. The Cr content is more preferably 1.5% or less, particularly preferably 1.0% or less.

The Ni content is more preferably 0.010% or more, particularly preferably 0.020% or more. The Ni content is more preferably 1.5% or less, particularly preferably 1.0% or less.

The Cu content is more preferably 0.010% or more, particularly preferably 0.020% or more. The Cu content is more preferably 1.5% or less, particularly preferably 1.0% or less.

B is an element effective in enhancing the hardenability of a steel sheet, forming martensite and bainite, and increasing the strength. To provide the effects, the B content is preferably 0.0003% or more, more preferably 0.0005% or more, particularly preferably 0.0010% or more. A B content of more than 0.0050% may result in the increase of inclusions to deteriorate the hole expansion formability. Accordingly, the B content is preferably 0.0050% or less, more preferably 0.0040% or less, particularly preferably 0.0030% or less.

Ca and REM are elements effective in improving the hole expansion formability by controlling the shape of inclusions. To provide the effect, each of the Ca content and the REM content is preferably 0.001% or more, more preferably 0.002 or more. When each of the Ca content and the REM content is more than 0.005%, the amount of inclusions is increased to deteriorate the hole expansion formability. Accordingly, each of the Ca content and the REM content is preferably 0.005% or less, more preferably 0.004% or less.

Sn and Sb are elements effective in inhibiting denitrization, deboronization, and so forth to inhibit a decrease in the strength of steel. To provide these effects, each of the Sn content and the Sb content is preferably 0.005% or more, more preferably 0.010% or more, particularly preferably 0.015% or more. When the Sn content and the Sb content are more than the respective upper limits, bendability is deteriorated by grain boundary embrittlement. Accordingly, each of the Sn content and the Sb content is preferably 0.50% or less, more preferably 0.45% or less, particularly preferably 0.40% or less.

The balance other than the above-described components is composed of Fe and incidental impurities. When the foregoing optional components are contained in amounts of less than the respective lower limits, these elements are regarded as incidental impurities. Regarding incidental impurities, 0.002% or less in total of Zr, Mg, La, and Ce as other elements may be contained. As an incidental impurity, N may be contained in an amount of 0.010% or less.

The steel microstructure of the high-strength steel sheet according to aspects of the present invention will be described below. The steel microstructure of the high-strength steel sheet according to aspects of the present invention contains, on an area percentage basis, 1% to 35% ferrite having an aspect ratio of 2.0 or more, 10% or less ferrite having an aspect ratio of less than 2.0, less than 5% non-recrystallized ferrite, 40% to 80% in total of bainite and martensite containing carbide, 5% to 35% in total of fresh martensite and retained austenite, and 3% to 35% retained austenite, the retained austenite having a C content of 0.40% to 0.70% by mass.

Ferrite having Aspect Ratio of 2.0 or More: 1% to 35%

The ferrite having an aspect ratio of 2.0 or more is formed during holding at Ac1+60° C. to Ac3 in main annealing and are required to promote bainite transformation during subsequent cooing and holding to obtain appropriate retained austenite. The ferrite having an aspect ratio of 2.0 or more distorts during large deformation to exhibit excellent energy absorption characteristics. To provide these effects, the area percentage of the ferrite having an aspect ratio of 2.0 or more needs to be 1% or more. The area percentage of the ferrite having an aspect ratio of 2.0 or more is preferably 3% or more, more preferably 5% or more. When the area percentage of the ferrite having an aspect ratio of 2.0 or more is more than 35%, both of a tensile strength (TS) of 1,180 MPa or more and good energy absorption characteristics are difficult to achieve. Accordingly, the area percentage of the ferrite having an aspect ratio of 2.0 or more needs to be 35% or less. The area percentage of the ferrite having an aspect ratio of 2.0 or more is preferably 30% or less, and more preferably 25% or less. In accordance with aspects of the present invention, the ferrite having an aspect ratio of 2.0 or more do not contain non-recrystallized ferrite. In the steel microstructure according to aspects of the present invention, typically, the aspect ratio is 10 or less.

Ferrite Having Aspect Ratio of Less than 2.0:10% or Less

The ferrite having an aspect ratio of less than 2.0 are less effective in promoting the bainite transformation and in being distorted during deformation, thereby leading to a decrease in strength and the deterioration of the hole expansion formability. For this reason, the fraction is preferably low. Thus, the ferrite having an aspect ratio of less than 2.0 may be 0% and can be acceptable up to 10% in accordance with aspects of the present invention. Accordingly, the area percentage of the ferrite having an aspect ratio of less than 2.0 needs to be 10% or less. The area percentage of the ferrite having an aspect ratio of less than 2.0 is preferably 8% or less, more preferably 5% or less.

Non-Recrystallized Ferrite: Less than 5%

The non-recrystallized ferrite deteriorates hole expansion formability and thus is preferably minimized. Thus, the area percentage of the non-recrystallized ferrite may be 0% and can be acceptable up to less than 5% in accordance with aspects of the present invention. Accordingly, the area percentage of the non-recrystallized ferrite needs to be less than 5%. The area percentage of the non-recrystallized ferrite is preferably 3% or less, more preferably 1% or less.

Total of Bainite and Martensite Containing Carbide: 40% to 80%

The incorporation of predetermined amounts of bainite having intermediate strength and ductility and martensite containing carbide results in stable energy absorption characteristics. To provide the effect, the total area percentage of bainite and martensite containing carbide needs to be 40% or more. The total area percentage of bainite and martensite containing carbide is preferably 45% or more, more preferably 50% or more. When the total area percentage of bainite and martensite containing carbide is more than 80%, uniform elongation in accordance with aspects of the present invention is not obtained. Accordingly, the total area percentage of bainite and martensite containing carbide needs to be 80% or less. The total area percentage of bainite and martensite containing carbide is preferably 75% or less, more preferably 70% or less.

Total of Fresh Martensite and Retained Austenite: 5% to 35%

Fresh martensite and retained austenite are structures effective in increasing uniform elongation. When the total area percentage of fresh martensite and retained austenite is less than 5%, uniform elongation in accordance with aspects of the present invention is not obtained. Thus, the total area percentage of fresh martensite and retained austenite needs to be 5% or more. The total area percentage of fresh martensite and retained austenite is preferably 8% or more, more preferably 10% or more. When the total area percentage of fresh martensite and retained austenite is more than 35%, a large crack is formed during axial crushing to fail to obtain good energy absorption characteristics. Accordingly, the total area percentage of fresh martensite and retained austenite needs to be 35% or less. The total area percentage of fresh martensite and retained austenite is preferably 30% or less, more preferably 25% or less.

Retained Austenite: 3% to 35%

Retained austenite is a structure needed to obtain good energy absorption characteristics. To provide the effect, the area percentage of retained austenite needs to be 3% or more. The area percentage of retained austenite is preferably 4% or more, more preferably 5% or more. When the area percentage of retained austenite is more than 35%, a large crack is formed to fail to obtain good energy absorption characteristics during axial crushing. Accordingly, the area percentage of retained austenite needs to be 35% or less. The area percentage of retained austenite is preferably 30% or less, more preferably 25% or less.

C Content of Retained Austenite: 0.40% to 0.70% by Mass

When the C content of retained austenite is less than 0.40% by mass, uniform elongation in accordance with aspects of the present invention is not obtained. Thus, the C content of retained austenite needs to be 0.40% or more by mass. The C content of retained austenite is preferably 0.45% or more by mass, more preferably 0.48% or more by mass. When the C content of retained austenite is more than 0.70% by mass, good energy absorption characteristics in accordance with aspects of the present invention are not obtained. Accordingly, the C content of retained austenite needs to be 0.70% or less by mass. The C content of retained austenite is preferably 0.65% or less by mass, more preferably 0.60% or less by mass.

Basically, pearlite is not contained in accordance with aspects of the present invention. Pearlite is not preferred, and thus the amount of pearlite is preferably 3% or less in terms of area percentage.

Structures other than the structures described above may be acceptable up to 3% in total.

The area percentages of ferrite, martensite, and bainite in accordance with aspects of the present invention refer to area percentages thereof with respect to an observation area. These area percentages are determined as follows: A sample is cut from an annealed steel sheet. A thickness section parallel to a rolling direction is polished and then etched with a 3% by mass nital. Images are acquired from three fields of view at each of a position in the vicinity of a surface of the steel sheet and a position 300 μm away from the surface of the steel sheet in the thickness direction with a scanning electron microscope (SEM) at a magnification of ×1,500. Area percentages of each structure are determined from the resulting image data using Image-Pro, available from Media Cybernetics, Inc. The average of the area percentages determined from the fields of view is defined as the area percentage of each structure. In the image data sets, ferrite is represented by black portions having many curved grain boundaries. Fresh martensite and retained austenite are represented by white or light gray portions. Bainite is represented by dark gray portions having many linear grain boundaries. Martensite containing carbide is represented by gray or dark gray portions. Non-recrystallized ferrite contains subgrain boundaries and thus can be distinguished from other ferrite structures. In accordance with aspects of the present invention, martensite containing carbide is tempered martensite. In accordance with aspects of the present invention, carbide is represented by white dots or lines and thus is distinguishable. Pearlite, which is not basically contained in accordance with aspects of the present invention, is represented by black and white layered structure and thus is distinguishable. The aspect ratio is defined as the ratio of the length of the longer axis to the length of the shorter axis of a grain.

The C content of retained austenite is calculated from the amount of the shift of a diffraction peak corresponding to the (220) plane measured with an X-ray diffractometer using CoKα radiation and by means of formulae [1] and [2] below.

$$a=1.7889\times(2)^{1/2}/\sin\theta \quad [1]$$

$$a=3.578+0.033[C]+0.00095[Mn]+0.0006[Cr]+0.022[N]+0.0056[Al]+0.0015[Cu]+0.0031[Mo] \quad [2]$$

In formula [1], a is the lattice constant (A) of austenite, and θ is a value (rad) obtained by dividing the diffraction peak angle corresponding to the (220) plane by 2. In formula [2], [M] is the percentage by mass of element M in austenite. In accordance with aspects of the present invention, the percentage by mass of the element M in retained austenite is the percentage by mass of the element M with respect to the entire steel.

The high-strength steel sheet according to aspects of the present invention may be a high-strength steel sheet including a coated layer on a surface thereof. The coated layer may be a hot-dip galvanized layer, an electrogalvanized layer, or a hot-dip aluminum-coated layer. The coated layer may be a hot-dip galvannealed layer formed by performing hot-dip galvanization and then alloying treatment.

The high-strength steel sheet according to aspects of the present invention has a tensile strength (TS) of 1,180 MPa or more, the tensile strength being determined by sampling a JIS No. 5 tensile test piece (JIS 22201) in a direction perpendicular to the rolling direction and performing a tensile test according to JIS Z 2241 at a strain rate of $10^{-3}$/s. The tensile strength (TS) of the high-strength steel sheet is preferably 1,300 MPa or less from the viewpoint of striking a balance with other characteristics.

In the high-strength steel sheet according to aspects of the present invention, the uniform elongation (UEL) determined by the tensile test described above is 9.0% or more. The uniform elongation (UEL) determined by the tensile test described above is preferably 15.0% or less from the viewpoint of striking a balance with other characteristics.

The average hole expansion ratio (%) of the high-strength steel sheet according to aspects of the present invention is 30% or more, the average hole expansion ratio being determined by sampling a 100 mm×100 mm test piece and performing a hole expanding test three times according to JFST 1001 (The Japan Iron and Steel Federation Standard, 2008) with a conical punch having a cone angle of 60°. The average hole expansion ratio (%) is preferably 60% or less from the viewpoint of striking a balance with other characteristics.

The high-strength steel sheet according to aspects of the present invention is excellent in energy absorption characteristics. Specifically, the evaluation of the energy absorption characteristics measured in examples is rated as "pass". What is necessary for the steel sheet to be rated as "pass" is that the percentages of the foregoing structures in the steel microstructure are within the respective specific ranges described above.

A method for producing the high-strength steel sheet according to aspects of the present invention will be described below. The method for producing the high-strength steel sheet according to aspects of the present invention includes a hot-rolling step, a cold-rolling step, a pre-annealing step, and a main-annealing step. A coating step may be included, as needed. Each step will be described below. Each of the temperatures described in the production conditions is the surface temperature of the steel sheet.

The hot-rolling step is a step of subjecting a slab having the foregoing component composition to hot rolling, cooling, and coiling at 590° C. or lower.

In accordance with aspects of the present invention, the slab is preferably produced by a continuous casting process in order to prevent macrosegregation. However, the slab may be produced by an ingot-making process or a thin slab casting process. To perform hot-rolling to the slab, the slab may be temporarily cooled to room temperature and reheated before hot rolling. The slab may be transferred into a heating furnace without cooling to room temperature, and then hot-rolled. An energy-saving process may be employed in which the slab is slightly insulated for a short time and then immediately hot-rolled. In the case of heating the slab, the slab is preferably heated to 1,100° C. or higher in order to dissolve carbides and prevent an increase in rolling load. To prevent an increase in the amount of scale loss, the heating temperature of the slab is preferably 1,300° C. or lower. The temperature of the slab is the temperature of a slab surface. In the case of hot-rolling the slab, a rough-rolled bar obtained by rough rolling may be heated. A continuous rolling process may be employed in which rough-rolled bars are joined to one another and continuously subjected to finish hot rolling. In the hot rolling, for the purposes of reducing the rolling load and providing a uniform shape and a uniform quality of the steel sheet, it is preferable to perform lubrication rolling, in which the coefficient of friction is reduced to 0.10 to 0.25, in all or some passes of the finish hot rolling.

The hot-rolling conditions are not particularly limited. The hot rolling may be performed under normal hot-rolling conditions. Examples of the normal hot-rolling conditions are as follows: the rough-rolling temperature is 1,000° C. to 1,100° C., the number of rolling passes is 5 to 15, and the finish hot rolling temperature is 800° C. to 1,000° C.

The cooling rate in cooling after the hot rolling is not particularly limited. The cooling here is normal cooling after the hot rolling. The average cooling rate may be 20 to 50° C./s. The cooling stop temperature is a coiling temperature described below.

Coiling Temperature: 590° C. or Lower

A coiling temperature of higher than 590° C. results in the formation of coarse carbides of V, Mo, Ti, and Nb to decrease the amount of carbon dissolved in steel, thus failing to obtain a desired steel microstructure after annealing. Accordingly, the coiling temperature needs to be 590° C. or lower. The lower limit need not be particularly limited. The coiling temperature is preferably 400° C. or higher in view of shape stability. After the coiling, scale is preferably removed by, for example, pickling.

The cold-rolling step is a step of cold-rolling a hot-rolled sheet obtained in the hot-rolling step at a rolling reduction of 20% or more.

Cold Rolling Reduction: 20% or More

A cold rolling reduction of less than 20% results in the formation of non-recrystallized ferrite to fail to obtain a desired steel microstructure. Accordingly, the cold rolling reduction needs to be 20% or more, preferably 30% or more. The upper limit need not be particularly specified. The cold rolling reduction is preferably 90% or less, more preferably 70% or less in view of shape stability and so forth.

The pre-annealing step is a step of heating a cold-rolled sheet obtained in the cold-rolling step to 830° C. to 940° C., holding the steel sheet in the temperature range of 830° C. to 940° C. for 10 seconds or more, and cooling the steel sheet to 550° C. or lower at an average cooling rate of 5° C./s or more.

Pre-Annealing Temperature: 830° C. to 940° C.

A pre-annealing temperature of lower than 830° C. results in the formation of a large amount of ferrite having an aspect ratio of less than 2.0 to fail to obtain a desired steel microstructure. A pre-annealing temperature of higher than 940° C. results in an increase in ferrite to fail to obtain bainite containing carbide or tempered martensite containing carbide. Accordingly, the pre-annealing temperature needs to be 830° C. to 940° C.

Pre-Annealing Holding Time: 10 Seconds or More

When a pre-annealing holding time, which is a holding time in the temperature range of 830° C. to 940° C., is less than 10 seconds, austenite is insufficiently formed, and a large amount of ferrite having an aspect ratio of less than 2.0 is formed, thereby failing to obtain a desired steel microstructure. Accordingly, the pre-annealing holding time needs to be 10 seconds or more, preferably 30 seconds or more. The upper limit need not be particularly specified. A pre-annealing holding time of more than 1,000 seconds results in a decrease in productivity. Thus, the pre-annealing holding time is preferably 1,000 seconds or less, more preferably 500 seconds or less.

Average Cooling Rate Until 550° C. or Lower After Holding in Pre-Annealing Temperature Range: 5° C./s or More After the holding in the pre-annealing temperature range, an average cooling rate of less than 5° C./s until 550° C. results in the formation of an excessive amount of ferrite (ferrite having an aspect ratio of less than 2.0) to fail to obtain a desired steel microstructure. Accordingly, the average cooling rate needs to be 5° C./s or more, preferably 8° C./s or more. The upper limit need not be particularly specified. The average cooling rate is preferably less than 100° C./s in view of shape stability. The average cooling rate can be determined by dividing a difference in temperature between the holding temperature in the pre-annealing temperature range and 550° C. by the time required to perform cooling from the holding temperature (cooling start temperature) in a main-annealing temperature range to 550° C.

The cooling stop temperature in the cooling described above is preferably 10° C. to 550° C. To obtain the cooling rate, the pre-annealing step is preferably performed by continuous annealing or the like, and box annealing is not preferred.

In the cooling described above, the steel sheet is preferably held in the temperature range of 100° C. to 450° C. for 30 seconds or more and then cooled to room temperature (10° C. to 30° C.). As long as the steel sheet is in the temperature range of 550° C. or lower, after the cooling is stopped once, reheating, holding, and so forth may be performed. For example, for the purpose of controlling reverse transformation during the main annealing by controlling an increase in the local concentration of C or for the purpose of stabilizing the shape, after the cooling is stopped once at 300° C. or lower, reheating to a temperature of 550° C. or lower and holding may be performed.

The main-annealing step is a step of heating the steel sheet after the pre-annealing step to Ac1+60° C. to Ac3, holding the steel sheet in the temperature range of Ac1+60° C. to Ac3 for 10 seconds or more, cooling the steel sheet to 550° C. at an average cooling rate of 10° C./s or more, holding the steel sheet in a temperature range of 550° C. to 400° C. for 2 to 10 seconds, further cooling the steel sheet to 150° C. to 375° C. at an average cooling rate of 5° C./s or more, reheating the steel sheet to 300° C. to 450° C., and holding the steel sheet in the temperature range of 300° C. to 450° C. for 10 to 1,000 seconds. In the case where the pre-annealing is not performed, the ferrite having an aspect ratio of 2.0 or more is not sufficiently formed. Thus, the non-recrystallized ferrite is increased to fail to obtain the energy absorption characteristics or the hole expansion formability according to aspects of the present invention.

Main-Annealing Temperature: Ac1+60° C. to Ac3

At a main-annealing temperature of lower than Ac1+60° C., austenite is insufficiently formed to fail to obtain a desired steel microstructure. At a main-annealing temperature of higher than Ac3, the ferrite having an aspect ratio of 2.0 or more is not sufficiently formed. Accordingly, the main-annealing temperature needs to be Ac1+60° C. to Ac3. Ac1 refers to an austenite formation start temperature. Ac3 refers to an austenite formation completion temperature.

Main-Annealing Holding Time: 10 Seconds or More

When the main-annealing holding time, which is a holding time in the temperature range of Ac1+60° C. to Ac3, is less than 10 seconds, austenite is insufficiently formed to fail to obtain a desired steel microstructure. Accordingly, the main-annealing holding time needs to be 10 seconds or more, more preferably 30 seconds or more. The upper limit need not be particularly specified. A main-annealing holding time of more than 1,000 seconds results in a decrease in productivity. Thus, the main-annealing holding time is preferably 1,000 seconds or less, more preferably 500 seconds or less.

Average Cooling Rate Until 550° C. After Holding in Main-Annealing Temperature Range: 10° C./s or More When the average cooling rate until 550° C. after the holding in the main-annealing temperature range is less than 10° C./s, an excessive amount of ferrite is formed to fail to obtain a desired steel microstructure. Accordingly, the average cooling rate until 550° C. after the holding in the main-annealing temperature range needs to be 10° C./s or more, preferably 20° C./s or more. The upper limit need not be particularly specified. The average cooling rate until 550° C. after the holding in the main-annealing temperature range is preferably less than 100° C./s in view of shape stability. Cooling that is performed at an average cooling rate of 10° C./s or more until 550° C. is referred to as first cooling.

The average cooling rate can be determined by dividing a difference in temperature between the holding temperature in the main-annealing temperature range and 550° C. by the time required to perform cooling from the holding temperature (cooling start temperature) in the main-annealing temperature range to 550° C.

Holding Time at 400° C. to 550° C.: 2 to 10 Seconds

In the first cooling performed at an average cooling rate of 10° C./s or more until 550° C., the cooling stop temperature needs to be in the range of 400° C. to 550° C., and the holding time in the range of 400° C. to 550° C. needs to be 2 to 10 seconds. When the holding is performed in the range of 400° C. to 550° C. for 2 to 10 seconds, an increase in the concentration of C in austenite is promoted. A desired steel microstructure is obtained by controlling the amount of transformation of bainite, the amount of transformation of martensite, and the amount of C in retained austenite. When the holding time at 400° C. to 550° C. is less than 2 seconds, the effect is insufficient, thereby failing to obtain a desired steel microstructure. When the holding time at 400° C. to 550° C. is more than 10 seconds, an excessive amount of bainite is formed, and the C content of retained austenite is not in a desired range. Accordingly, the holding time at 400° C. to 550° C. needs to be 2 to 10 seconds, preferably 2 to 8 seconds, more preferably 2 to 5 seconds.

Average Cooling Rate of Cooling After Holding: 5° C./s or More

After the holding at 400° C. to 550° C., cooling is further performed to a cooling stop temperature. This cooling is referred to as second cooling. When the average cooling rate in the second cooling is less than 5° C./s, an excessive amount of bainite is formed, and the C content of retained austenite is not in a desired range. Accordingly, the average cooling rate until the cooling stop temperature after the holding at 400° C. to 550° C. needs to be 5° C./s or more. The upper limit need not be particularly specified, and is preferably less than 100° C./s in view of shape stability. The average cooling rate can be determined by dividing a difference in temperature between the holding temperature and the cooling stop temperature by the time required to perform cooling from the holding temperature (cooling start temperature) to the cooling stop temperature.

Cooling Stop Temperature in Second Cooling: 150° C. to 375° C.

A cooling stop temperature of lower than 150° C. results in the formation of an excessive amount of tempered martensite to fail to obtain fresh martensite and retained austenite according to aspects of the present invention. At a cooling stop temperature of higher than 375° C., bainite containing carbide and tempered martensite containing carbide are not formed, thereby decreasing the C content of retained y. Accordingly, the cooling stop temperature needs to be 150° C. to 375° C., preferably 180° C. to 300° C.

Reheating Temperature: 300° C. to 450° C.

When the reheating temperature is lower than 300° C. or higher than 450° C., bainite transformation is suppressed, and the C content of retained austenite is not in a desired range. Accordingly, the reheating temperature needs to be 300° C. to 450° C., preferably 325° C. to 425° C.

Reheating Holding Time: 10 to 1,000 Seconds

A reheating holding time of less than 10 seconds results in insufficient bainite transformation, and the C content of retained austenite is not in a desired range. A reheating holding time of more than 1,000 seconds results in pearlite and an excessive amount of bainite transformation to fail to obtain a desired steel microstructure. Accordingly, the reheating holding time needs to be 10 to 1,000 seconds, preferably 20 to 300 seconds.

The coating step is a step of subjecting the steel sheet after the main-annealing step to coating treatment and is performed as needed. Regarding a coating treatment method, a usual method may be employed in accordance with a coated layer to be formed. In the case of hot-dip galvanizing treatment, alloying treatment may be performed thereafter.

Example 1

Aspects of the present invention will be specifically described on the basis of the examples. The technical scope of the present invention is not limited to the following examples.

Molten steels having component compositions presented in Table 1 (the balance being Fe and incidental impurities) were produced with a vacuum smelting furnace in a laboratory and rolled into steel slabs. These steel slabs were subjected to heating to 1,200° C., followed by rough rolling and hot rolling under conditions presented in Tables 2 and 3 to produce hot-rolled sheets. Subsequently, the hot-rolled steel sheets were cold-rolled to a thickness of 1.0 mm, thereby producing cold-rolled sheets. The resulting cold-rolled sheets were subjected to annealing. The annealing was performed with an apparatus for heat treatment and coating treatment in a laboratory under conditions presented in Table 2 to produce hot-dip galvannealed steel sheets (GA), hot-dip galvanized steel sheets (GI), and cold-rolled steel sheets (CR) 1 to 45. Each of the hot-dip galvanized steel sheets was produced by immersing a corresponding one of the sheets in a coating bath having a temperature of 465° C. to form a coated layer on each side of the steel sheet, the coated layer having a coating weight of 40 to 60 g/m$^2$ per side. Each of the hot-dip galvannealed steel sheets was produced by immersing a corresponding one of the sheets in the coating bath having a temperature of 465° C. to form a coated layer on each side of the steel sheet, the coated layer having a coating weight of 40 to 60 g/m$^2$ per side, and holding the resulting steel sheet at 540° C. for 1 to 60 seconds. After the coating treatment, these steel sheets were cooled to room temperature at 8° C./s.

The tensile properties, the hole expansion formability, and the energy absorption characteristics of the resulting steel sheets were evaluated according to the following testing methods. Area percentages of steel microstructures and the C content of retained austenite were measured by the methods described above. Table 4 presents these results.

<Tensile Test>

JIS No. 5 tensile test pieces (JIS 22201) were sampled from the steel sheets in a direction perpendicular to a rolling direction. A tensile test was performed according to JIS Z 2241 at a strain rate of $10^{-3}$/s, thereby determining tensile strength (TS) and uniform elongation. In the examples, a tensile strength (TS) of 1,180 MPa or more was evaluated as acceptable, and a uniform elongation (UEL) of 9.0% or more was evaluated as acceptable.

<Hole Expansion Formability>

The stretch-flangeability was evaluated on the basis of a hole expansion ratio (%). The hole expansion ratio was determined by sampling a 100 mm×100 mm test piece and performing a hole expanding test three times according to JFST 1001 (The Japan Iron and Steel Federation Standard, 2008) with a conical punch having a cone angle of 60°. In the examples, a hole expansion ratio of 30% or more was evaluated as satisfactory.

<Energy Absorption Characteristics>

Figure 2:
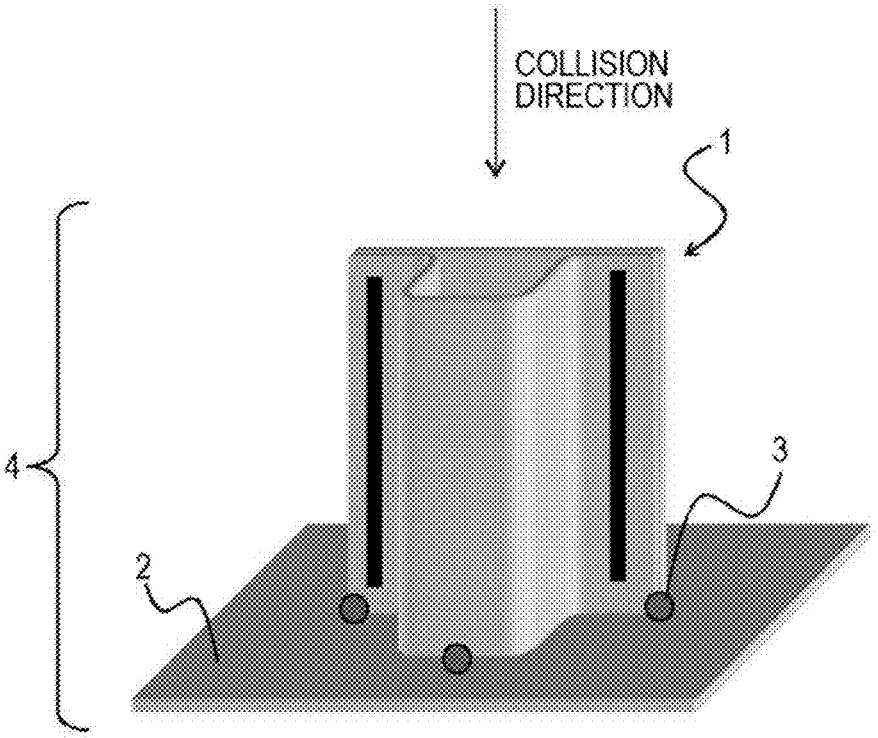
FIG. 2 is a perspective view of a crushing specimen 4.

A test piece having a width of 120 mm and a length of 78 mm and a test piece having a width of 120 mm and a length of 150 mm were taken from each of the steel sheets, the width direction being perpendicular to the rolling direction. Each of the test pieces was subjected to bending work at a bend radius of 3 mm and laser welding, thereby producing an axial crushing component 1. FIG. 1 is a perspective view of the axial crushing component 1. Then the axial crushing component 1 and a base plate 2 were joined by TIG welding 3 to produce a crushing specimen 4. FIG. 2 is a perspective view of the crushing specimen 4.

The energy absorption characteristics were evaluated by a crushing test with the crushing specimen 4. The crushing test was performed as follows: An impactor was allowed to collide with the crushing specimen 4 from above at a constant collision velocity of 10 m/s to crush the specimen by 80 mm. After the crushing, in the case where the crushing specimen 4 was crushed in a bellows-like manner and where no crack having a length of 50 mm or more was formed, the specimen was rated as "pass". In the case where a crack having a length of 50 mm or more was formed, the specimen was rated as "fail".

TABLE 1

| | Component composition (% by mass) | | | | | | | | | | | Ac1 transformation | Ac3 transformation | |
|---|---|---|---|---|---|---|---|---|---|---|---|---|---|---|
| Steel | C | Si | Mn | P | S | Al | V | Mo | Ti | Nb | Others | point (° C.) | point (° C.) | Remarks |
| A | 0.20 | 0.9 | 3.4 | 0.010 | 0.002 | 0.03 | 0.10 | 0.20 | 0.030 | 0.010 | — | 676 | 817 | within scope of invention |
| B | 0.15 | 1.4 | 3.1 | 0.010 | 0.002 | 0.03 | | 0.30 | 0.030 | | — | 696 | 853 | within scope of invention |
| C | 0.17 | 1.8 | 2.1 | 0.010 | 0.002 | 0.03 | 0.10 | 0.10 | | | — | 724 | 887 | within scope of invention |
| D | 0.25 | 0.5 | 2.4 | 0.010 | 0.002 | 0.30 | 0.20 | | | 0.020 | — | 643 | 865 | within scope of invention |
| E | 0.19 | 2.0 | 3.0 | 0.010 | 0.002 | 0.03 | | | 0.030 | 0.020 | Ni: 0.2 | 702 | 864 | within scope of invention |
| F | 0.18 | 0.7 | 3.3 | 0.010 | 0.002 | 0.60 | | | | 0.030 | Cr: 0.4 | 575 | 897 | within scope of invention |
| G | 0.16 | 1.5 | 2.6 | 0.010 | 0.002 | 0.03 | | 0.50 | | 0.010 | Cu: 0.2 | 715 | 865 | within scope of invention |
| H | 0.22 | 1.0 | 3.6 | 0.010 | 0.002 | 0.80 | 0.20 | | 0.020 | | B: 0.0015 | 538 | 965 | within scope of invention |
| I | 0.13 | 1.7 | 2.9 | 0.010 | 0.002 | 0.03 | 0.30 | | | | Ca: 0.003 | 701 | 888 | within scope of invention |
| J | 0.17 | 1.5 | 2.8 | 0.010 | 0.002 | 0.03 | 0.20 | 0.20 | 0.020 | | REM: 0.002 | 703 | 875 | within scope of invention |
| K | 0.21 | 1.6 | 2.7 | 0.010 | 0.002 | 0.03 | 0.10 | | 0.020 | 0.020 | Sn: 0.20 | 702 | 857 | within scope of invention |
| L | 0.20 | 1.2 | 3.2 | 0.010 | 0.002 | 0.03 | | 0.20 | 0.010 | 0.010 | Sb: 0.02 | 687 | 818 | within scope of invention |
| M | 0.20 | 1.2 | 3.2 | 0.010 | 0.002 | 0.03 | 0.50 | | | | — | 682 | 860 | within scope of invention |
| N | 0.20 | 1.2 | 3.2 | 0.010 | 0.002 | 0.03 | | 0.70 | | | — | 698 | 830 | within scope of invention |

TABLE 1-continued

| Steel | Component composition (% by mass) C | Si | Mn | P | S | Al | V | Mo | Ti | Nb | Others | Ac1 transformation point (° C.) | Ac3 transformation point (° C.) | Remarks |
|---|---|---|---|---|---|---|---|---|---|---|---|---|---|---|
| O | 0.20 | 1.2 | 3.2 | 0.010 | 0.002 | 0.03 | | | 0.060 | | — | 682 | 832 | within scope of invention |
| P | 0.20 | 1.2 | 3.2 | 0.010 | 0.002 | 0.03 | | | | 0.060 | — | 682 | 808 | within scope of invention |
| Q | 0.10 | 1.3 | 3.0 | 0.010 | 0.002 | 0.03 | 0.10 | 0.30 | | 0.020 | — | 699 | 865 | outside scope of invention |
| R | 0.32 | 1.3 | 2.1 | 0.010 | 0.002 | 0.03 | 0.10 | 0.30 | | 0.020 | — | 715 | 841 | outside scope of invention |
| S | 0.19 | 0.4 | 2.6 | 0.010 | 0.002 | 0.03 | | 0.30 | 0.030 | 0.010 | — | 690 | 814 | outside scope of invention |
| T | 0.19 | 3.3 | 3.0 | 0.010 | 0.002 | 0.03 | | 0.30 | 0.030 | 0.010 | — | 732 | 931 | outside scope of invention |
| U | 0.20 | 1.2 | 1.8 | 0.010 | 0.002 | 0.03 | 0.20 | | 0.030 | 0.020 | — | 717 | 883 | outside scope of invention |
| V | 0.15 | 1.9 | 4.1 | 0.010 | 0.002 | 0.03 | 0.10 | 0.10 | 0.010 | 0.010 | — | 676 | 842 | outside scope of invention |
| W | 0.15 | 1.8 | 3.1 | 0.010 | 0.002 | 0.03 | | | | | — | 697 | 850 | outside scope of invention |
| X | 0.15 | 1.8 | 3.1 | 0.010 | 0.002 | 0.03 | | | 0.120 | | — | 697 | 898 | outside scope of invention |

TABLE 2

| Steel sheet No. | Steel | Hot rolling condition: Coiling temperature (° C.) | Cold rolling condition: Cold rolling reduction (%) | Pre-annealing condition: Annealing temperature (° C.) | Annealing holding time (s) | Average cooling rate (° C./s) | Cooling stop temperature (° C.) | Reheating temperature (° C.) | Holding time (s) |
|---|---|---|---|---|---|---|---|---|---|
| 1 | A | 500 | 50 | 830 | 200 | 20 | 200 | — | 300 |
| 2 | | 630 | 50 | 830 | 200 | 20 | 200 | — | 300 |
| 3 | | 500 | 15 | 830 | 200 | 20 | 200 | — | 300 |
| 4 | B | 500 | 50 | 800 | 100 | 30 | 200 | 350 | 300 |
| 5 | | 500 | 50 | 880 | 5 | 30 | 200 | 350 | 300 |
| 6 | | 500 | 50 | 880 | 100 | 30 | 200 | 350 | 300 |
| 7 | C | 500 | 50 | 920 | 200 | 50 | 100 | — | 100 |
| 8 | | 500 | 50 | 920 | 200 | 2 | 100 | — | 100 |
| 9 | | 500 | 50 | 920 | 200 | 50 | 600 | — | 100 |
| 10 | D | 500 | 50 | 900 | 100 | 10 | 400 | — | 50 |
| 11 | | 500 | 50 | 900 | 100 | 10 | 400 | — | 50 |
| 12 | | 500 | 50 | 900 | 100 | 10 | 400 | — | 50 |
| 13 | E | 400 | 50 | 900 | 100 | 10 | 400 | — | 50 |
| 14 | | 400 | 50 | 980 | 100 | 10 | 400 | — | 50 |
| 15 | | 400 | 50 | 900 | 100 | 10 | 400 | — | 50 |
| 16 | F | 400 | 50 | 900 | 100 | 10 | 25 | — | — |
| 17 | | 400 | 50 | 900 | 100 | 10 | 25 | — | — |
| 18 | | 400 | 50 | 900 | 100 | 10 | 25 | — | — |
| 19 | | 400 | 50 | 900 | 100 | 10 | 25 | — | — |
| 20 | G | 500 | 35 | 900 | 200 | 50 | 300 | — | 600 |
| 21 | | 500 | 35 | 900 | 200 | 50 | 300 | — | 600 |
| 22 | | 500 | 35 | 900 | 200 | 50 | 300 | — | 600 |
| 23 | H | 450 | 70 | 930 | 300 | 10 | 400 | — | 600 |
| 24 | | 450 | 70 | 930 | 300 | 10 | 400 | — | 600 |
| 25 | | 450 | 70 | 930 | 300 | 10 | 400 | — | 600 |
| 26 | I | 500 | 50 | 880 | 100 | 10 | 400 | — | 200 |
| 27 | | 500 | 50 | 880 | 100 | 10 | 400 | — | 200 |
| 28 | | 500 | 50 | 880 | 100 | 10 | 400 | — | 200 |
| 29 | J | 500 | 50 | 900 | 200 | 20 | 400 | — | 200 |
| 30 | | 500 | 50 | — | — | — | — | — | — |
| 31 | K | 500 | 50 | 900 | 200 | 20 | 400 | — | 200 |
| 32 | | 500 | 50 | 900 | 200 | 20 | 400 | — | 200 |
| 33 | L | 500 | 50 | 900 | 200 | 20 | 400 | — | 200 |
| 34 | M | 500 | 50 | 900 | 200 | 20 | 400 | — | 200 |
| 35 | N | 500 | 50 | 900 | 200 | 20 | 400 | — | 200 |
| 36 | O | 500 | 50 | 900 | 200 | 20 | 400 | — | 200 |
| 37 | P | 500 | 50 | 900 | 200 | 20 | 400 | — | 200 |
| 38 | Q | 500 | 50 | 900 | 200 | 20 | 400 | — | 200 |
| 39 | R | 500 | 50 | 900 | 200 | 20 | 400 | — | 200 |
| 40 | S | 500 | 50 | 900 | 200 | 20 | 400 | — | 200 |
| 41 | T | 500 | 50 | 940 | 200 | 20 | 400 | — | 200 |

TABLE 2-continued

| Steel sheet No. | Steel | Hot rolling condition: Coiling temperature (° C.) | Cold rolling condition: Cold rolling reduction (%) | Pre-annealing condition: Annealing temperature (° C.) | Annealing holding time (s) | Average cooling rate (° C./s) | Cooling stop temperature (° C.) | Reheating temperature (° C.) | Holding time (s) |
|---|---|---|---|---|---|---|---|---|---|
| 42 | U | 500 | 50 | 900 | 200 | 20 | 400 | — | 200 |
| 43 | V | 500 | 50 | 900 | 200 | 20 | 400 | — | 200 |
| 44 | W | 500 | 50 | 900 | 200 | 20 | 400 | — | 200 |
| 45 | X | 500 | 50 | 900 | 200 | 20 | 400 | — | 200 |

TABLE 3

| Steel sheet No. | Steel | Main-annealing condition: Annealing temperature (° C.) | Annealing holding time (s) | Average cooling rate*1 (° C./s) | Holding time*2 (s) | Average cooling rate*3 (° C./s) | Cooling stop temperature (° C.) | Reheating temperature (° C.) | Holding time*4 (s) | Surface*5 | Remarks |
|---|---|---|---|---|---|---|---|---|---|---|---|
| 1 | A | 815 | 60 | 30 | 3 | 8 | 180 | 400 | 100 | GA | Example |
| 2 | | 815 | 60 | 30 | 3 | 8 | 180 | 400 | 100 | GA | Comparative example |
| 3 | | 815 | 60 | 30 | 3 | 8 | 180 | 400 | 100 | GA | Comparative example |
| 4 | B | 830 | 100 | 30 | 5 | 8 | 250 | 350 | 100 | GA | Comparative example |
| 5 | | 830 | 100 | 30 | 5 | 8 | 250 | 350 | 100 | GA | Comparative example |
| 6 | | 830 | 100 | 30 | 5 | 8 | 250 | 350 | 100 | GA | Example |
| 7 | C | 850 | 200 | 30 | 2 | 8 | 180 | 330 | 30 | GA | Example |
| 8 | | 850 | 200 | 30 | 2 | 8 | 180 | 330 | 30 | GA | Comparative example |
| 9 | | 850 | 200 | 30 | 2 | 8 | 180 | 330 | 30 | GA | Comparative example |
| 10 | D | 840 | 100 | 10 | 3 | 5 | 250 | 380 | 30 | GA | Example |
| 11 | | 700 | 100 | 10 | 3 | 5 | 250 | 380 | 30 | GA | Comparative example |
| 12 | | 840 | 5 | 10 | 3 | 5 | 250 | 380 | 30 | GA | Comparative example |
| 13 | E | 800 | 100 | 10 | 3 | 5 | 200 | 380 | 30 | GA | Example |
| 14 | | 800 | 100 | 10 | 3 | 5 | 250 | 380 | 30 | GA | Comparative example |
| 15 | | 900 | 100 | 10 | 3 | 5 | 250 | 380 | 30 | GA | Comparative example |
| 16 | F | 800 | 100 | 20 | 3 | 5 | 210 | 420 | 150 | Gl | Example |
| 17 | | 800 | 100 | 20 | 11 | 5 | 210 | 420 | 150 | Gl | Comparative example |
| 18 | | 800 | 100 | 20 | 1 | 5 | 210 | 420 | 150 | Gl | Comparative example |
| 19 | | 800 | 100 | 20 | 3 | 1 | 210 | 420 | 150 | Gl | Comparative example |
| 20 | G | 850 | 150 | 30 | 4 | 10 | 280 | 330 | 300 | GA | Example |
| 21 | | 850 | 150 | 30 | 4 | 10 | 100 | 330 | 300 | GA | Comparative example |
| 22 | | 850 | 150 | 30 | 4 | 10 | 280 | 480 | 300 | GA | Comparative example |
| 23 | H | 880 | 100 | 20 | 3 | 5 | 200 | 400 | 300 | GA | Example |
| 24 | | 880 | 100 | 20 | 3 | 5 | 400 | 400 | 300 | GA | Comparative example |
| 25 | | 880 | 100 | 20 | 3 | 5 | 200 | 250 | 300 | GA | Comparative example |
| 26 | I | 840 | 100 | 10 | 8 | 8 | 240 | 450 | 200 | CR | Example |
| 27 | | 840 | 100 | 10 | 8 | 8 | 240 | 450 | 8 | CR | Comparative example |
| 28 | | 840 | 100 | 10 | 8 | 8 | 240 | 450 | 1200 | CR | Comparative example |
| 29 | J | 820 | 100 | 20 | 3 | 6 | 230 | 400 | 100 | GA | Example |
| 30 | | 820 | 100 | 20 | 3 | 6 | 230 | 400 | 100 | GA | Comparative example |
| 31 | K | 820 | 100 | 20 | 3 | 6 | 200 | 400 | 100 | GA | Example |
| 32 | | 820 | 100 | 8 | 3 | 6 | 200 | 400 | 100 | GA | Comparative example |
| 33 | L | 800 | 100 | 20 | 3 | 6 | 200 | 400 | 100 | GA | Example |
| 34 | M | 830 | 100 | 20 | 3 | 6 | 200 | 400 | 100 | Gl | Example |
| 35 | N | 800 | 100 | 20 | 3 | 6 | 200 | 400 | 100 | Gl | Example |

TABLE 3-continued

| Steel sheet No. | Steel | Main-annealing condition: Annealing temperature (° C.) | Annealing holding time (s) | Average cooling rate*1 (° C./s) | Holding time*2 (s) | Average cooling rate*3 (° C./s) | Cooling stop temperature (° C.) | Reheating temperature (° C.) | Holding time*4 (s) | Surface*5 | Remarks |
|---|---|---|---|---|---|---|---|---|---|---|---|
| 36 | O | 800 | 100 | 20 | 3 | 6 | 200 | 400 | 100 | Gl | Example |
| 37 | P | 800 | 100 | 20 | 3 | 6 | 200 | 400 | 100 | Gl | Example |
| 38 | Q | 830 | 100 | 20 | 3 | 6 | 250 | 400 | 100 | GA | Comparative example |
| 39 | R | 780 | 100 | 20 | 3 | 6 | 160 | 400 | 100 | GA | Comparative example |
| 40 | S | 800 | 100 | 20 | 3 | 6 | 220 | 400 | 100 | GA | Comparative example |
| 41 | T | 900 | 100 | 20 | 3 | 6 | 150 | 400 | 100 | GA | Comparative example |
| 42 | U | 840 | 100 | 20 | 3 | 6 | 280 | 400 | 100 | GA | Comparative example |
| 43 | V | 820 | 100 | 20 | 3 | 6 | 180 | 400 | 100 | GA | Comparative example |
| 44 | W | 830 | 100 | 20 | 3 | 6 | 200 | 400 | 100 | Gl | Comparative example |
| 45 | X | 820 | 100 | 20 | 3 | 6 | 200 | 400 | 100 | Gl | Comparative example |

*1An average cooling rate in the range of the annealing temperature to 550° C.
*2A holding time at a temperature in the range of 400° C. to 550° C.
*3An average cooling rate from a holding temperature to a cooling stop temperature.
*4A holding time in the temperature range of 300° C. to 450° C.
*5GA: hot-dip galvannealed steel sheet, Gl: hot-dip galvanized steel sheet, CR: cold rolled (non-coated)

TABLE 4

| Steel sheet No. | Steel microstructure: V(F1)*1 (%) | V(F2)*2 (%) | V(F3)*3 (%) | V(BMC)*4 (%) | V(MG)*5 (%) | V(G)*6 (%) | Others*7 |
|---|---|---|---|---|---|---|---|
| 1 | 15 | 1 | 0 | 70 | 14 | 12 | — |
| 2 | 29 | 5 | 0 | 5 | 60 | 13 | P |
| 3 | 13 | 1 | 7 | 64 | 15 | 10 | — |
| 4 | 8 | 20 | 0 | 52 | 20 | 13 | — |
| 5 | 7 | 22 | 3 | 43 | 25 | 13 | — |
| 6 | 12 | 0 | 0 | 71 | 17 | 10 | — |
| 7 | 27 | 2 | 0 | 56 | 15 | 10 | — |
| 8 | 10 | 35 | 0 | 27 | 28 | 9 | — |
| 9 | 11 | 33 | 0 | 29 | 27 | 10 | — |
| 10 | 24 | 0 | 0 | 63 | 11 | 6 | P |
| 11 | 48 | 1 | 0 | 8 | 40 | 5 | P |
| 12 | 44 | 1 | 0 | 11 | 42 | 5 | P |
| 13 | 30 | 0 | 0 | 55 | 15 | 11 | — |
| 14 | 35 | 2 | 0 | 20 | 43 | 16 | — |
| 15 | 0 | 0 | 0 | 91 | 9 | 9 | — |
| 16 | 28 | 1 | 0 | 59 | 12 | 10 | — |
| 17 | 27 | 1 | 0 | 64 | 8 | 8 | — |
| 18 | 27 | 1 | 0 | 69 | 3 | 3 | — |
| 19 | 28 | 1 | 0 | 63 | 8 | 8 | — |
| 20 | 14 | 0 | 0 | 65 | 21 | 13 | — |
| 21 | 14 | 0 | 0 | 84 | 2 | 2 | — |
| 22 | 14 | 0 | 0 | 50 | 36 | 17 | — |
| 23 | 18 | 6 | 0 | 58 | 18 | 10 | — |
| 24 | 19 | 5 | 0 | 0 | 76 | 6 | — |
| 25 | 18 | 6 | 0 | 44 | 32 | 15 | — |
| 26 | 13 | 1 | 1 | 65 | 20 | 12 | — |
| 27 | 14 | 1 | 1 | 55 | 29 | 14 | — |
| 28 | 14 | 1 | 1 | 69 | 4 | 3 | P |
| 29 | 20 | 0 | 0 | 70 | 10 | 9 | — |
| 30 | 0 | 14 | 5 | 58 | 23 | 11 | — |
| 31 | 18 | 0 | 0 | 64 | 18 | 12 | — |
| 32 | 37 | 1 | 0 | 42 | 20 | 10 | — |
| 33 | 10 | 0 | 0 | 74 | 16 | 8 | — |
| 34 | 11 | 0 | 2 | 65 | 22 | 12 | — |
| 35 | 11 | 0 | 3 | 63 | 23 | 12 | — |
| 36 | 12 | 0 | 4 | 60 | 24 | 12 | — |
| 37 | 10 | 0 | 4 | 64 | 22 | 11 | — |
| 38 | 57 | 5 | 0 | 1 | 37 | 9 | — |
| 39 | 28 | 3 | 0 | 38 | 31 | 18 | — |

TABLE 4-continued

| | | | | | | | |
|---|---|---|---|---|---|---|---|
| 40 | 15 | 0 | 0 | 73 | 12 | 2 | — |
| 41 | 24 | 6 | 0 | 55 | 15 | 10 | — |
| 42 | 39 | 8 | 0 | 38 | 15 | 6 | — |
| 43 | 16 | 0 | 0 | 59 | 25 | 14 | — |
| 44 | 15 | 0 | 0 | 66 | 19 | 11 | — |
| 45 | 16 | 23 | 0 | 34 | 27 | 10 | — |

| Steel sheet No. | Steel microstructure C(RA)*8 (% by mass) | Tensile property value TS (MPa) | Tensile property value UEL (%) | Hole expansion formability λ (%) | Energy absorption characteristics | Remarks |
|---|---|---|---|---|---|---|
| 1 | 0.46 | 1284 | 10.0 | 35 | pass | Example |
| 2 | 0.50 | 1166 | 10.5 | 28 | fail | Comparative example |
| 3 | 0.47 | 1297 | 9.3 | 22 | pass | Comparative example |
| 4 | 0.49 | 1253 | 9.4 | 31 | fail | Comparative example |
| 5 | 0.48 | 1259 | 9.2 | 30 | fail | Comparative example |
| 6 | 0.55 | 1240 | 11.3 | 41 | pass | Example |
| 7 | 0.64 | 1193 | 12.1 | 38 | pass | Example |
| 8 | 0.60 | 1122 | 11.8 | 25 | fail | Comparative example |
| 9 | 0.61 | 1119 | 11.7 | 25 | fail | Comparative example |
| 10 | 0.63 | 1244 | 9.8 | 31 | pass | Example |
| 11 | 0.62 | 1334 | 9.1 | 11 | fail | Comparative example |
| 12 | 0.61 | 1326 | 9.3 | 12 | fail | Comparative example |
| 13 | 0.50 | 1213 | 11.8 | 34 | pass | Example |
| 14 | 0.53 | 1148 | 12.5 | 16 | fail | Comparative example |
| 15 | 0.47 | 1218 | 9.1 | 50 | fail | Comparative example |
| 16 | 0.49 | 1235 | 12.3 | 33 | pass | Example |
| 17 | 0.74 | 1233 | 12.8 | 37 | fail | Comparative example |
| 18 | 0.39 | 1247 | 8.9 | 45 | pass | Comparative example |
| 19 | 0.72 | 1230 | 12.7 | 37 | fail | Comparative example |
| 20 | 0.60 | 1221 | 11.9 | 38 | pass | Example |
| 21 | 0.59 | 1256 | 8.1 | 48 | fail | Comparative example |
| 22 | 0.38 | 1260 | 8.7 | 33 | pass | Comparative example |
| 23 | 0.48 | 1285 | 10.1 | 32 | pass | Example |
| 24 | 0.25 | 1362 | 8.8 | 19 | fail | Comparative example |
| 25 | 0.38 | 1313 | 8.9 | 27 | pass | Comparative example |
| 26 | 0.65 | 1192 | 11.3 | 45 | pass | Example |
| 27 | 0.39 | 1267 | 8.9 | 34 | pass | Comparative example |
| 28 | 0.49 | 1184 | 8.7 | 40 | pass | Comparative example |
| 29 | 0.59 | 1215 | 10.7 | 38 | pass | Example |
| 30 | 0.48 | 1221 | 9.3 | 29 | fail | Comparative example |
| 31 | 0.55 | 1236 | 10.5 | 31 | pass | Example |
| 32 | 0.48 | 1248 | 9.3 | 27 | fail | Comparative example |
| 33 | 0.50 | 1228 | 10.0 | 33 | pass | Example |
| 34 | 0.60 | 1270 | 10.4 | 41 | pass | Example |
| 35 | 0.61 | 1285 | 10.8 | 36 | pass | Example |
| 36 | 0.60 | 1244 | 10.3 | 35 | pass | Example |
| 37 | 0.59 | 1243 | 10.1 | 33 | pass | Example |
| 38 | 0.53 | 1025 | 11.1 | 46 | pass | Comparative example |
| 39 | 0.51 | 1331 | 9.6 | 21 | fail | Comparative example |
| 40 | 0.47 | 1195 | 9.1 | 39 | fail | Comparative example |
| 41 | 0.55 | 1265 | 12.5 | 20 | fail | Comparative example |

TABLE 4-continued

| | | | | | | |
|---|---|---|---|---|---|---|
| 42 | 0.52 | 1128 | 9.6 | 29 | fail | Comparative example |
| 43 | 0.45 | 1214 | 11.2 | 25 | fail | Comparative example |
| 44 | 0.54 | 1263 | 10.9 | 39 | fail | Comparative example |
| 45 | 0.53 | 1168 | 10.2 | 26 | fail | Comparative example |

*1V(F1): The area percentage of ferrite having an aspect ratio of 2.0 or more.
*2V(F2): The area percentage of ferrite having an aspect ratio of less than 2.0.
*3V(F3): The area percentage of unrecrystallized ferrite.
*4V(BMC): The total area percentage of bainite and carbide-containing martensite.
*5V(MG): The total area percentage of fresh martensite and retained austenite.
*6V(G): The area percentage of retained austenite.
*7Others P: Pearlite
*8C(RA): The C content of retained austenite.

Each of the high-strength steel sheets of the examples had a tensile strength (TS) of 1,180 MPa or more, a uniform elongation of 9.0% or more, a hole expansion ratio of 30% or more, and excellent energy absorption characteristics. In comparative examples outside the scope according to aspects of the present invention, one or more of desired tensile strength (TS), uniform elongation, hole expansion formability, and energy absorption characteristics were not obtained.

REFERENCE SIGNS LIST

1 axial crushing component
2 base plate
3 TIG welding
4 crushing specimen

The invention claimed is:

1. A high-strength steel sheet, comprising a component composition containing, on a percent by mass basis:
C: 0.12% to 0.30%,
Si: 0.5% to 3.0%,
Mn: 2.0% to 4.0%,
P: 0.100% or less,
S: 0.02% or less,
Al: 0.01% to 1.50%, and
at least one selected from V: 0.1% to 1.5%, Mo: 0.1% to 1.5%, Ti: 0.005% to 0.10%, and Nb: 0.005% to 0.10%, the balance being Fe and incidental impurities; and
a steel microstructure containing, on an area percent basis,
1% to 35% ferrite, based on the total area percent in the steel microstructure, having an aspect ratio of 2.0 or more,
10% or less ferrite, based on the total area percent in the steel microstructure, having an aspect ratio of less than 2.0,
less than 5% non-recrystallized ferrite, based on the total area percent in the steel microstructure,
40% to 80% in total of bainite and martensite containing carbide,
5% to 35% in total of fresh rnartensite and retained austenite, and
3% to 35% retained austenite,
the retained austenite having a C content of 0.40% to 0.7 by mass,
wherein the high-strength steel sheet has a tensile strength of 1,180 MPa or more.

2. The high-strength steel sheet according to claim 1 further comprising, on a percent by mass basis:
at least one element selected from Cr: 0.005% to 2.0%, Ni: 0.005% to 2.0%, Cu: 0. 005% to 2.0%, B: 0.0003% to 0,0050%, Ca: 0.001% to 0.005%, REM: 0.001% to 0.005%, Sn: 0.005% to 0.50%, and Sb: 0.005% to 0.50%.

3. The high-strength steel sheet according to claim 1, further comprising a coated layer.

4. The high-strength steel sheet according to claim 2, further comprising a coated layer.

5. The high-strength steel sheet according to claim 3, wherein the coated layer is a hot-dip galvanized layer or a hot-dip galvannealed layer.

6. The high-strength steel sheet according to claim 4, wherein the coated layer is a hot-dip galvanized layer or a hot-dip galvannealed layer.

7. The high-strength steel sheet according to claim 1, wherein the retained austenite has the C content of 0.40 to 0.64% by mass.

8. A method for producing a high-strength steel sheet, comprising:
a hot-rolling step of hot-rolling a slab having a component composition according to claim 1, performing cooling, and performing coiling at 590° C. or lower;
a cold-rolling step of cold-roiling a hot-rolled, sheet obtained in the hot-rolling step at a rolling reduction of 20% or more;
a pre-annealing step of heating a cold-rolled sheet obtained in the cold-rolling step to 830° C. to 940° C., holding the steel sheet in the temperature range of 830° C. to 940° C. for 10 seconds or more, and cooling the steel sheet to 550° C. or lower at an average cooling rate of 5° Cis or more; and
a main-annealing step of heating the steel sheet after the pre-annealing step to Ac1+60° C. to Ac3, holding the steel sheet in the temperature range of Ac1+60° C. to Ac3 for 10 seconds or more, cooling the steel sheet to 550° C. at an average cooling rate of 10° C./s is or more, holding the steel sheet in a temperature range of 550° C. to 400° C. for 2 to 10 seconds, cooling the steel sheet to 150° C. to 375° C. at an average cooling rate of 5° C./s or more, reheating the steel sheet to 300° C. to 450° C., and holding the steel sheet in the temperature range of 300° C. to 450° C. for 10 to 1,000 seconds.

9. The method for producing a high-strength steel sheet according to claim 7, further comprising a coating step of subjecting the steel sheet after the main-annealing step to coating treatment.

10. The method for producing a high-strength steel sheet according to claim 9, wherein the coating treatment is hot-dip galvanizing treatment or coating treatment in which hot-dip galvanizing treatment is performed and then alloying treatment is performed.

11. The method for producing a high-strength steel sheet according to claim 8, wherein the holding time in the temperature range of 550° C. to 400° C. is 2 to 8 seconds in the main-annealing step.

12. A method for producing a high-strength steel sheet, comprising:

a hot-rolling step of hot-rolling a slab having a component composition accordingto claim 2, performing cooling, and performing coiling at 590° C. or lower;

a cold-rolling step of cold-rolling a hot-rolled sheet obtained in the hot-rolling step at a rolling reduction of 20% or more;

a pre-annealing step of heating a cold-rolled sheet obtained in the cold-rolling step to 830° C. to 940° C., holding the steel sheet in the temperature range of 830° C. to 940° C. for 10 seconds or more, and cooling the steel sheet to 550° C. or lower at an average cooling rate of 5° C./s or more; and a main-annealing step of heating the steel sheet after the pre-annealing step to Ac1+60° C. to Ac3, holding the steel sheet in the temperature range of Ac1+60° C. to Ac3 for 10 seconds or more, cooling the steel sheet to 550° C. at an average cooling rate of 10° C./s or more, holding the steel sheet in a temperature range of 550° C. to 400° C. for 2 to 10 seconds, cooling the steel sheet to 150° C. to 375° C. at an average cooling rate of 5° C./s or more, reheating the steel sheet to 300° C. to 450° C., and holding the steel sheet in the temperature range of 300° C. to 450° C. for 10 to 1,000 seconds.

13. The method for producing a high-strength steel sheet according to claim 12, further comprising a coating step of subjecting the steel sheet after the main-annealing step to coating treatment.

14. The method for producing a high-strength steel sheet according to claim 13, wherein the coating treatment is hot-dip galvanizing treatment or coating treatment in which hot-dip galvanizing treatment is performed and then alloying treatment is performed.

* * * * *